United States Patent [19]

Woods

[11] 4,193,354

[45] Mar. 18, 1980

[54] SOLID WASTE DISPOSAL SYSTEM

[76] Inventor: Maurice G. Woods, P.O. Box 18662, Oklahoma City, Okla. 73118

[21] Appl. No.: 843,855

[22] Filed: Oct. 20, 1977

[51] Int. Cl.[2] ..... F23G 5/12

[52] U.S. Cl. ..... 110/212; 110/222; 110/179; 110/193; 110/234

[58] Field of Search ..... 110/179, 187, 212, 220, 110/222, 255

[56] References Cited

U.S. PATENT DOCUMENTS

| | | | |
|---|---|---|---|
| 2,000,296 | 5/1935 | Osborn | 110/255 |
| 2,869,487 | 1/1959 | Sherman | 110/211 |
| 3,323,475 | 6/1967 | Melgaard | 110/187 |
| 3,403,643 | 10/1968 | Denig | 110/220 |
| 3,602,161 | 8/1971 | Wyrough | 110/179 |
| 3,670,669 | 6/1972 | Hoad | 110/222 |
| 3,792,671 | 2/1974 | Woods | 110/187 |

*Primary Examiner*—Kenneth W. Sprague

*Attorney, Agent, or Firm*—Hubbard, Thurman, Turner, Tucker & Glaser

[57] ABSTRACT

A waste disposal system for the thermal conversion of municipal and industrial solid wastes into essentially pollution free products of combustion is disclosed. The waste disposal system includes a building enclosure having an interior storage area for accumulating combustible refuse, and an incinerator for thermally oxidizing the refuse. In a preferred embodiment, the incinerator includes a combustion chamber which is maintained at a reduced pressure level relative to the pressure of the surrounding atmosphere. This subatomspheric pressure arrangement produces a positive flow of air into the chamber as it is loaded thereby permitting loading during combustion virtually without risk of injury to personnel or damage to surrounding combustible material. In another preferred embodiment, the incinerator includes a primary combustion chamber which is maintained in an excess air condition as combustion occurs, and a secondary combustion chamber into which an auxiliary source of fuel such as natural gas is injected. Heat energy is recovered by conveying the exhaust gases from the secondary combustion chamber through a steam generator for the production of steam to operate an industrial process or for the operation of a steam turbine prime mover for generating electricity. The rate at which auxiliary fuel is injected into the secondary combustion chamber is controlled to ensure complete combustion of the exhaust gases to meet environmental standards, and to sustain the generation of a predetermined minimum level of heat energy in the exhaust gases for supporting the continuous production of steam to compensate for a temporary shortage of refuse derived fuel.

13 Claims, 5 Drawing Figures

SOLID WASTE DISPOSAL SYSTEM

BACKGROUND OF THE INVENTION

1. Field of the Invention

The present invention relates generally to combustion apparatus and to a method for operating combustion apparatus, and more particularly relates to method and apparatus for the efficient reduction of solid waste material deposited within an enclosure including means for effecting substantially complete thermal combustion of the solid waste material.

2. Description of the Prior Art

The disposal of solid waste is becoming an increasingly serious problem because of the large volumes of municipal and industrial solid waste materials being generated. This material includes a large volume of combustible refuse and a relatively smaller volume of recoverable resources such as ferrous and nonferrous metals. In the case of combustible solid waste products, incineration has proven to be a convenient way of reducing the volume of these products. Incineration units can be installed at industrial plants, apartment complexes, and shopping centers for thermal reduction. Combustion of waste products is a convenient solution in that large volumes of solid waste material can be reduced into a relatively small amount of residue. Therefore transportation and handling of the large quantities of solid waste is minimized to the disposal of the relatively small amount of ash and other residue at a suitable location. Landfills, which often consume large valuable tracts of urban land and which are expensive to maintain as well as being unsanitary and unsightly, can be eliminated or at least utilized more efficiently.

Rapidly escalating energy costs and increased awareness as to the scarcity of fossil fuels has caused many industries and utilities to consider the thermal conversion of solid waste material as an alternate energy source. Concurrently, many municipalities are faced with environmental regulations and community objections which are increasing the cost and problems associated with the operation of conventional solid waste disposal systems. The incineration of waste materials presents formidable problems because of the increasing emphasis on environmental quality which has led to surveillance and regulation by Federal and local authority. Federal and local legislation in this area no longer permit uncontrolled emissions from solid waste incinerators. Clean air legislation regulates the acceptable amount of particulate material and the constituency of off-gases from the waste disposal systems. Failure to abide by the regulatory acts in this area can result in penalties as well as the imposition of permanent injunctions against operation.

Energy and resource recovery from the conversion of municipal solid waste material is now feasible on the relatively small scale afforded by on-site operations due to recent advances in technology. The fuel fraction of municipal waste, refuse derived fuel, can be incinerated in modular combustors and the heat from combustion used to generate steam for process industries, for driving turbine generators, and other applications. The resource fraction of the municipal solid waste, such as ferrous and nonferrous metals, can be extracted during preparation of the refuse derived fuel and sold to secondary metal markets. The remaining fraction or residue of the conversion process can be used for landfill purposes.

Because of the diminishing availability of landfill space within a reasonable distance of metropolitan and industrial areas, and because of the substantial economic benefit derived from the recovery of heat energy and other resources incidental to the thermal conversion of solid waste material, there exists an urgent need for a solid waste disposal system which can operate economically within the boundary of a standard metropolitan statistical area and in compliance with environmental regulations. To date, no system attempting to accomplish these purposes has been entirely satisfactory.

According to conventional prior art approaches, solid waste material is incinerated and heat energy is recovered from the exhaust gases for the generation of steam. For such an operation to be successful, the steam is delivered continuously to an industrial user on a take-or-pay contract basis. The continuous production of steam requires that an adequate supply of refuse derived fuel be made available for incineration on a continuous basis. However, municipal sanitary waste material is typically gathered during a relatively few days of the week. Therefore, a practical energy and resource recovery system must include a primary storage area for accumulating a relatively large supply of municipal solid waste. Additionally, in order to enhance the profitability of the waste recovery operation, the system should include processing equipment for separating and recovering ferrous and nonferrous metals from the combustible waste material for sale to secondary metal markets. Such processing equipment may operate only eight hours a day for five days a week. Therefore, the system should include a secondary storage area for accumulating a relatively large supply of refuse derived fuel which will ensure the continuous operation of one or more incinerators.

The accumulation of such large amounts of solid waste material and refuse derived fuel which are essential to continuous, profitable operation of the incinerators and waste heat recovery system gives rise to large volumes of offensive odors and malodorous gases which must be prevented from escaping into the atmosphere in order to make the presence of such a facility acceptable to the community and in order to comply with environmental regulations.

SUMMARY OF THE INVENTION

The present invention provides an efficient, effective method and apparatus which thermally oxidizes municipal solid waste material and effectively eliminates the discharge of pollutants and offensive odors into the atmosphere. With the method and apparatus of the present invention, combustion of hydrocarbons is essentially complete and fly ash is settled out so that exhaust gases contain primarily only carbon dioxide, nitrogen, oxygen and water vapor. Malodorous gases which emanate from accumulations of solid waste material are mixed with refuse derived fuel in a primary combustion chamber of an incinerator.

The waste disposal system of the present invention includes a building enclosure having an interior storage area for accumulating municipal solid waste. An incinerator is provided for thermally oxidizing combustible refuse derived from the combustible solid material. In a preferred embodiment, the incinerator includes a primary combustion chamber which is maintained at a reduced pressure level relative to the pressure of the surrounding atmosphere. This subatmospheric pressure arrangement produces a positive flow of air into the chamber as it is loaded thereby permitting loading of additional refuse during on-going combustion virtually without risk of injury to personnel or damage to surrounding combustible material. The reduced pressure level is maintained by a draft flow of hot exhaust gases which is induced by directing a high velocity jet of auxiliary fuel vertically through an after burner chamber and stack which are connected to the primary combustion chamber. In one arrangement, the draft is augmented by an induced draft blower associated with the heat exchanger of a steam generating assembly. According to a further arrangement, the draft is augmented by directing a flow of combustion air at a pressure greater than atmospheric pressure into the primary combustion chamber and in a direction to produce a strong draft away from the loading doorway and toward the after burner combustion chamber. The flow rate of combustion air is controlled to maintain an amount of combustion air in the primary combustion chamber in excess of the amount required for complete combustion.

In yet another preferred embodiment, the incinerator includes a combustion chamber having an air supply inlet port disposed in fluid communication with the interior of the building enclosure. Means are provided for evacuating air from the interior of the enclosure into the inlet port of the combustion chamber at a rate sufficient to maintain a net positive flow of ambient air into the interior of the building enclosure whereby malodorous gases emanating from refuse accumulated within the enclosure are drawn into the combustion chamber for undergoing combustion during incineration of the refuse. According to this arrangement, a low air pressure condition is maintained inside of the building enclosure relative to the atmospheric pressure of ambient air surrounding the enclosure whereby the malodorous gases emanating from the refuse accumulated within the enclosure are drawn within the chamber for undergoing combustion during the incineration process. The interior air and malodorous gases undergo complete combustion and are replaced by the net positive flow of ambient air into the enclosure so that the offensive gases are prevented from escaping into the atmosphere.

According to an important aspect of the invention, the incinerator includes a secondary combustion chamber which is connected in fluid communication with the primary combustion chamber and which includes an auxiliary source of fuel for ensuring the complete combustion of off-gases discharged from the primary combustion chamber. The rate at which auxiliary fuel is injected into the secondary combustion chamber is controlled to ensure complete combustion of the off-gases to meet environmental standards, and in the absence of an adequate supply of refuse derived fuel, to sustain the generation of a predetermined minimum level of heat energy in the exhaust gases for supporting the continuous production of steam in associated heat exchanger and steam generating equipment.

According to another arrangement, means are provided for evacuating air from the interior of the enclosure into the primary combustion chamber at a rate sufficient to maintain the primary combustion chamber at an excess air condition as combustion occurs and which is also sufficient to maintain a net positive flow of ambient air surrounding the enclosure into the interior of the enclosure whereby malodorous gases emanating from the waste material accumulated within the enclosure are drawn into the primary combustion chamber for undergoing combustion during the incineration process. Regulator means are provided for controlling the rate that fuel is injected into the primary and secondary combustion chambers to maintain predetermined combustion temperatures.

In a regenerative mode of operation, heated exhaust air from the secondary combustion chamber is discharged into the primary combustion chamber where it is mixed with the interior air and malodorous gases for maintaining the excess air condition and for increasing the temperature of the air supply thereby reducing the auxiliary fuel requirement for the secondary combustion chamber. Heated exhaust gases from the secondary combustion chamber are also discharged through a heat exchanger for the production of steam.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawing.

DETAILED DESCRIPTION

Figure 1:
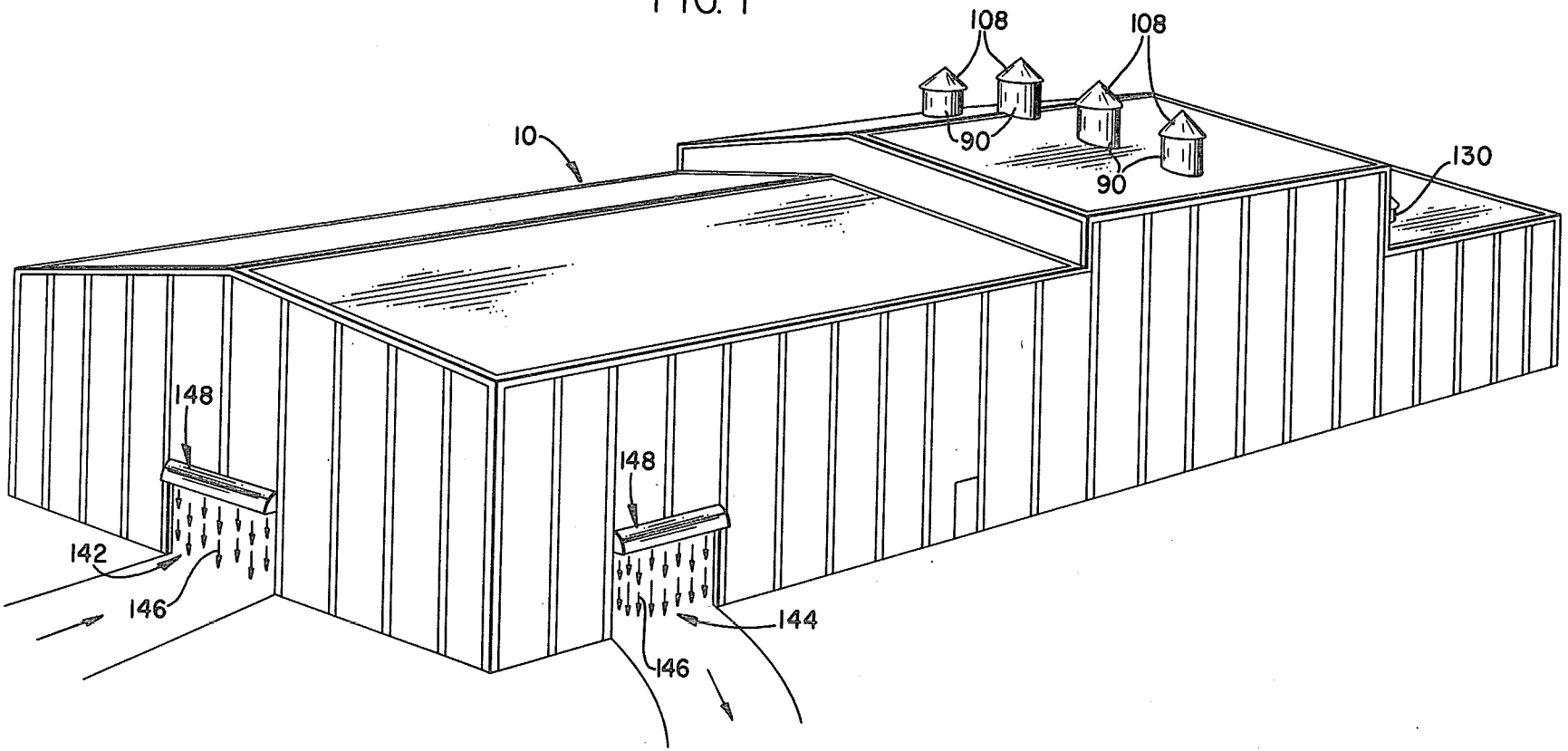
FIG. 1 is a perspective view of a building enclosure in which the waste disposal and energy and resource recovery system of the present invention is disposed.

In the description which follows and in the several figures of the drawing, like parts are marked with the same reference numerals respectively.

Referring now to the several figures of the drawing, apparatus for carrying out the method of the present invention will be described. A building enclosure 10 is shown which is adapted to receive a volume of municipal solid waste (MSW) material delivered by collection trucks 12 which dump the municipal solid waste on the tipping floor 14 of the building enclosure 10. The trucks 12 may be twenty cubic yard packer trucks which average approximately 80 percent full to the tipping floor. The tipping floor 14 serves as a primary storage zone for the accumulation of municipal solid waste to ensure a continuous supply of raw material for processing into refuse derived fuel (RDF). It may be convenient and desirable in certain building constructions to provide a large storage hopper to serve as the primary storage zone. In this arrangement (not illustrated), the MSW may be dumped directly into the storage hopper from which it is conveyed into a shredder for comminution.

The solid waste disposal and resource recovery system disposed within the building enclosure 10 is intended for disposing of residential and commercial as well as industrial refuse. In overall concept, the system includes the tipping floor 14 for accumulating a large volume of municipal solid waste 16, a processing section 18 which converts the municipal solid waste 16 into refuse derived fuel 20 and extracts recoverable resources, an intermediate storage area 22 for accumulating a large volume of the refuse derived fuel to assure continuous operation of the system, a number of incinerators 24 for thermally oxidizing the refuse derived fuel, and a corresponding number of steam generators assemblies 26 for recovering heat energy from the waste gases produced by the incinerator 24 for the production of steam for use in an industrial process or to provide the power for driving a prime mover in the production of electricity.

Figure 2A:
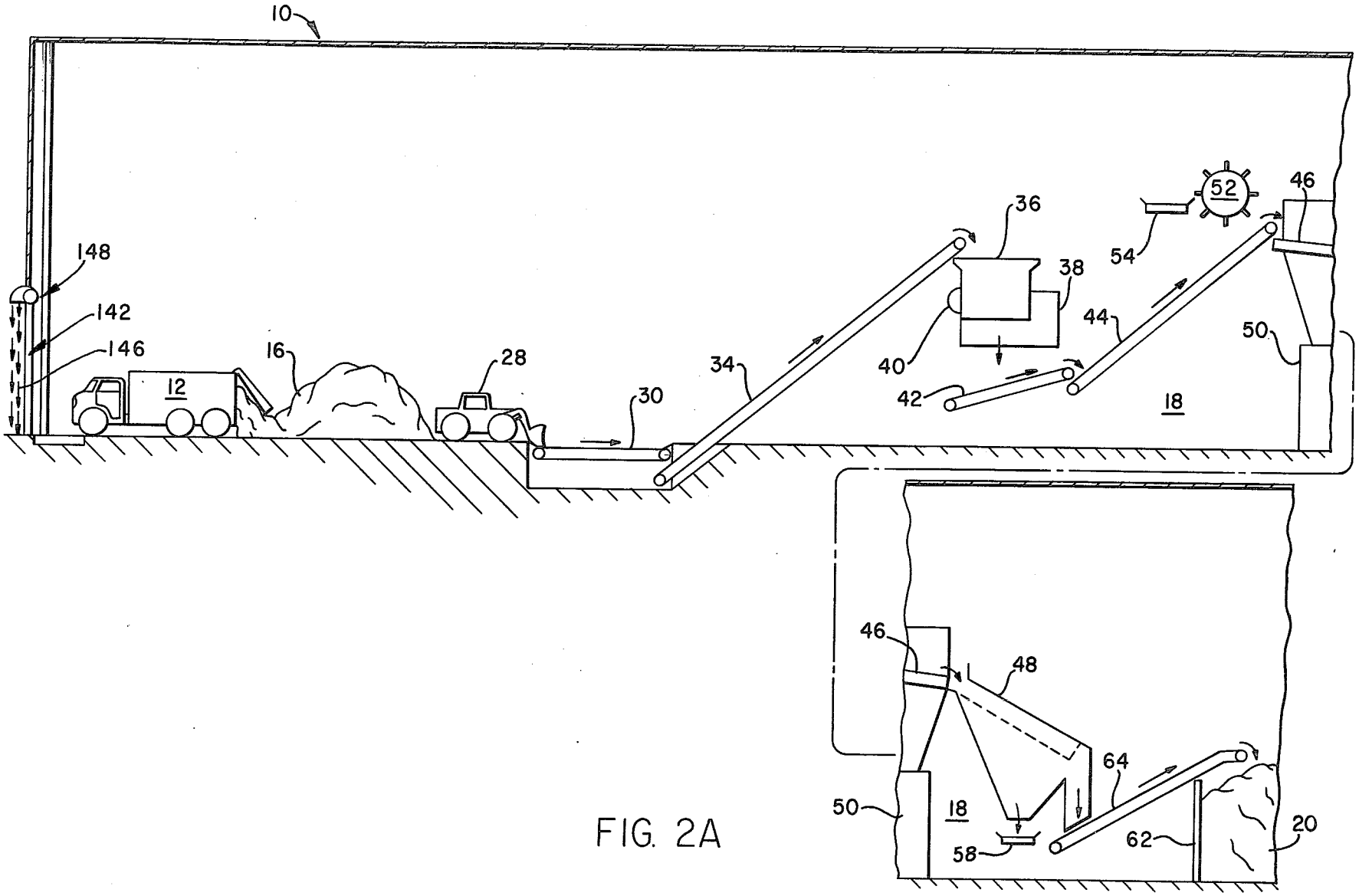
FIG. 2A is a process flow diagram of the solid waste disposal system of FIG. 1.
Figure 2B:
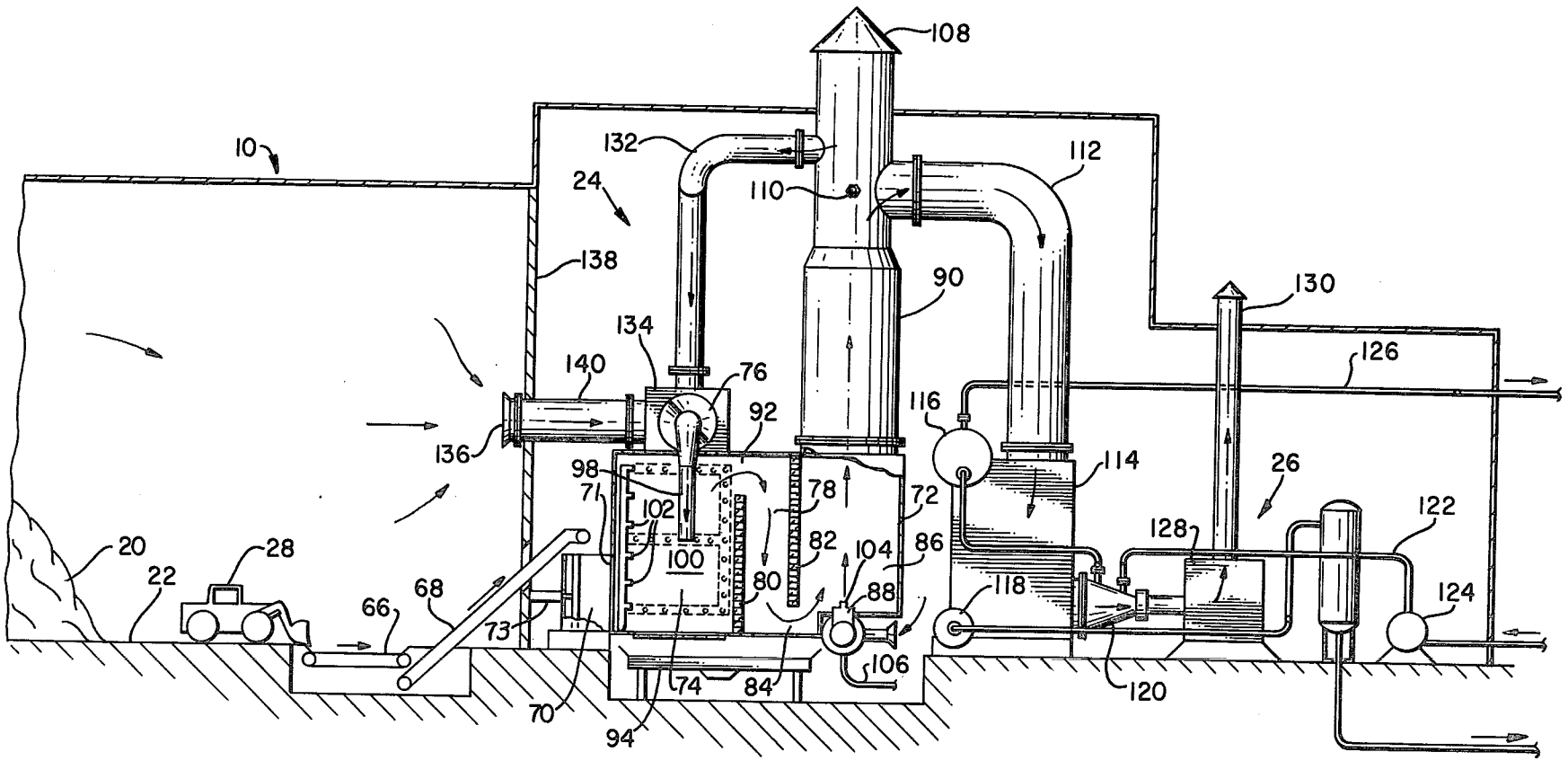
FIG. 2B is a continuation of the process flow diagram shown in FIG. 2A.

Referring now to FIGS. 2A and 2B of the drawing, municipal solid waste 16 is collected and transported in the trucks 12 and is delivered onto the tipping floor 14 where it is accumulated for processing. The municipal solid waste 16 is conveyed in bulk by means of a front-loader truck 28 which loads a municipal solid waste receiving conveyer 30 for initial transport to the processing section. The receiving conveyer 30 is preferably a flat belt conveyer having typical dimensions of six feet in width and approximately 30 feet in length, and includes flat idlers with a variable speed drive. The top of the MSW receiving conveyer 30 is several inches below the tipping floor and a six foot high sideboard is provided along the longitudinal back side of the MSW conveyer 30 to permit easy loading by the front loader 28. Delivery to the processing section 16 is completed by means of a shredder feed conveyer 34 which delivers the bulk municipal solid waste 16 into a shredder hopper 36. The shredder discharge conveyer 34 is preferably a belt conveyer which is typically three feet wide and approximately 14 feet long having flat idlers, constant speed drive, and sideboards on each side. The shredder hopper 36 is a welded construction which is capable of holding 100 cubic yards of municipal solid waste. A flat belt conveyer system (not shown) is disposed on three sides of the hopper for forcing the MSW into a shredder 38 located immediately beneath the hopper 36. On the fourth side of the hopper is a hydraulically operated disc type knife 40 which is used to prevent bridging of the MSW within the hopper 36.

The shredder 38 is operated by a pair of 150 horsepower hydraulic motors with automatic anti-jamming reversing capability. The shredder 38 is mounted on castors so as to provide accessibility for maintenance. The shredder 38 includes two rotors containing carbon steel cutters that are adjustable for different size cuts. The hydraulic motors are preferably energized by means of a pair of electrically driven hydraulic pumps. The shredder 38 is capable of running off of one of the hydraulic pumps under low feed rate conditions or both of the hydraulic pumps under design conditions. The hydraulic system which drives the shredder is designed to permit the shredder rotors to reverse if the cutters hit an object that does not shear. The municipal solid waste material 16 which passes through the shredder is comminuted into various sizes. If desired, the shredded material may be deposited upon a closed circuit screen (not shown) through which the shredded material of a predetermined uniform maximum size can pass onto a return conveyer so that any shredded material which is above a desired maximum size may be recycled into the shredder for further reduction to assure that material of the predetermined maximum size only is passed on for further processing.

After the MSW has been shredded, it is discharged onto a shredder discharge conveyer 42 which is a flat belt conveyer having flat idlers, sideboards and a constant speed drive. Typical dimensions for the shredder discharge conveyer 42 are a width of three feet and a length of 14 feet. A transfer conveyer 44 of similar construction transports the shredded MSW to an elevated position above an aluminum picking conveyer 46 and a vibrating screen 48. The aluminum picking conveyer 46 is a vibrating steel pan approximately three feet wide by eight feet long with eight inch high sideboards driven by a fixed rate feeder drive. The purpose of the aluminum picking conveyer 46 is to permit the manual extraction of aluminum cans which pass through the shredder 38. The aluminum recovered at this station is deposited within an aluminum waste bin 50.

Disposed immediately above one end of the transfer conveyer 44 is a drum magnet assembly 52 which is typically 49 inches in diameter and 48 inches in width. This assembly is an electromagnetic drum separator having a manganese steel shell, a constant speed drive, and electrically energized through a rectifier circuit (not shown). The drum magnet separator assembly is suspended above the transfer conveyer 44 to draw off ferrous metals from the shredded MSW 16. Ferrous metals recovered by by the drum magnet separator assembly 52 are dumped into a ferrous metal conveyer 54 which conveys the ferrous metal into a ferrous metal waste bin 56.

After the ferrous metals and aluminum have been recovered, the shredded MSW passes over the vibrating screen 48 which typically has a capacity of 350 tons per hour and has the capability to separate broken glass, grit and small metal particles from the MSW. The vibrating screen 48 is typically four feet wide by eight feet long and is complete with the frame, covers, oversize and undersize hoppers, and includes a specially designed motor for shaking the screen for removal of glass and grit particles. The glass, grit, and small metal particles which pass through the vibrating screen are transported by a flat belt grit conveyer 58 into a grit waste bin 60.

After passing over the vibrating screen 48, the extraction of refuse derived fuel from the municipal solid waste 16 is completed, and the refuse derived fuel (RDF) is transported over a retaining wall 62 and dumped onto the intermediate storage area 22 by means of an RDF transfer conveyer 64. The RDF transfer conveyer is a two foot wide belt conveyer with 20 degree troughing idlers and a constant speed drive. The RDF 20 transported by the RDF transfer conveyer 64 is dumped onto the intermediate RDF storage area 22 for accumulation of a large volume of refuse derived fuel to assure a continuous supply of fuel for the incinerators 24.

Figure 3A:
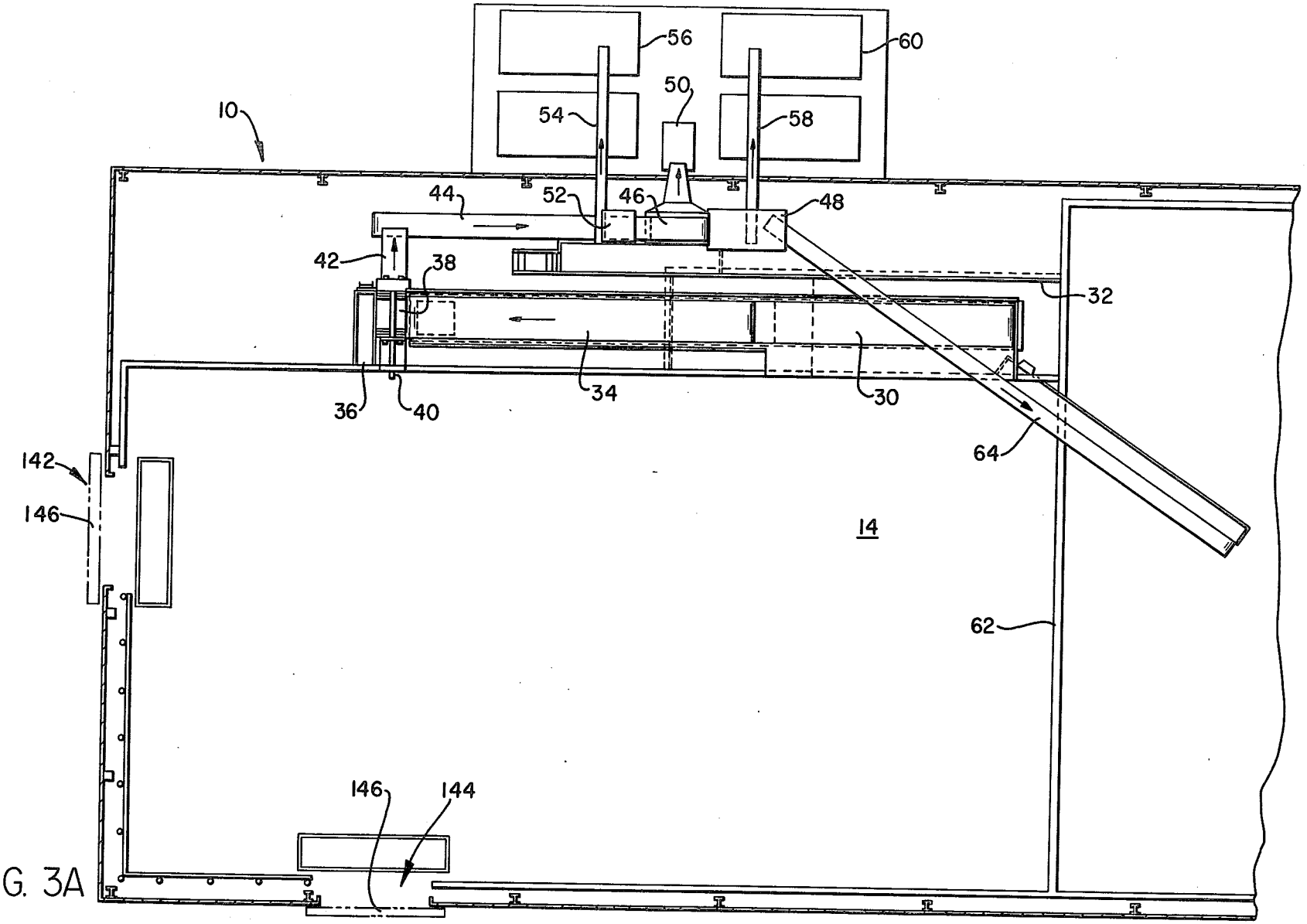
FIG. 3A is a plan view of the solid waste disposal system of FIG. 1.
Figure 3B:
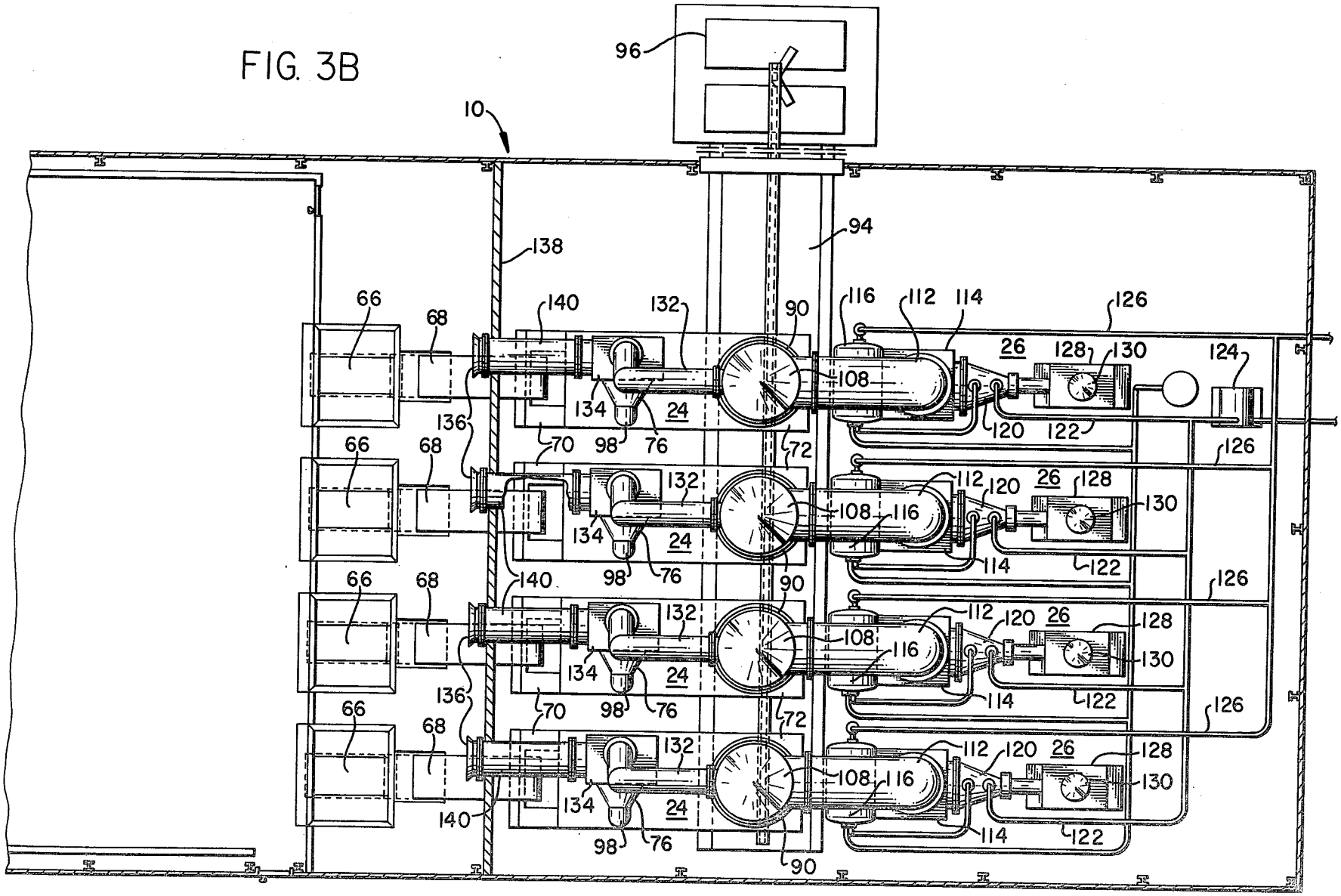
FIG. 3B is a continuation of the plan view of FIG. 3A.

Referring now to FIGS. 2B and 3B, the incinerator system of the invention comprises a bank of four incinerators 24 in which the RDF 20 is reduced by thermal oxidation. The modular incinerator arrangement illustrated in FIG. 3B permits the continuous disposal of refuse derived fuel while one or more of the incinerators is shut down for routine maintenance. However, all four of the incinerators may be operated continuously in combinaton with a corresponding number of steam generator assemblies 26 to assure the constant production of steam for a base load customer.

RDF 20 is off-loaded from the intermediate storage area 22 by means of a front-loader truck 28 which dumps small loads of the RDF 20 onto one or more of the RDF receiving conveyers 66. Each of the RDF receiving conveyers are flat belt type conveyers having flat idlers and a constant speed drive. The top of each belt is approximately two feet below floor level to accommodate off-loading by the frontloader truck. Transfer to the incinerator is accomplished by means of a RDF feed conveyer 68 which includes a cleated belt for transfer of the RDF into each incinerator 24. The RDF 20 is carried to a relatively elevated position above and away from the intermediate storage area 22 where it is dumped into an incinerator feeder 70. Each incinerator feeder 70 has a capacity of one cubic yard and includes a refractory lined fire door 71, a feed shut-off device, and a pneumatic operated ram assembly 73 for displacing the RDF load into the interior of each incinerator 72.

Since the RDF is preprocessed from the municipal solid waste, a relatively homogeneous flow of combustible material is delivered to each incinerator, thereby permitting 24 hour operation, and also permitting continuous full-time energy recovery from the combustible fraction of the waste.

Each of the incinerators 72 preferably has the capacity to oxidize 2,000 pounds of RDF per hour. This capacity is rated on the basis of continuous operation and each incinerator is designed to function at that level, in compliance with all environmental and pollution regulations. An incinerator structure which is capable of meeting these requirements is disclosed and claimed in U.S. Pat. No. 3,792,671 entitled "Incinerator With After Burner" by Maurice G. Woods, said patent being hereby incorporated by reference.

Each incinerator 72 includes a primary combustion chamber 74 having at least two gas fired burners (not shown) and a combustion air blower 76 which directs an excess amount of air into the primary combustion chamber according to an important feature of the invention which will be discussed in detail hereinafter. The incinerator 72 also includes a down pass chamber 78 which is defined by an internal baffling arrangement which includes a bridge wall 80 and a drop arch wall 82 which is longitudinally spaced from the bridge wall and which extends downwardly from the top of the incinerator terminating above the floor of the incinerator defining a restrictive flow opening 84. Each incinerator 72 also includes a secondary or after burner combustion chamber 86 which includes at least one gas fired burner 88 and an exhaust stack 90. The entire incinerator is lined with suitable insulation and refractory material.

The baffling arrangement of the bridge wall 80 and drop arch wall 82 also define a restrictive flow path 92 which permits all gases generated in the primary combustion chamber 74 to be conveyed through the down pass chamber 78 and through the restrictive flow opening 84 into the after burner combustion chamber 86. The velocity of the fluent gases flowing through the down pass chamber 78 is controlled by virtue of the restrictive flow openings at 84 and 92 so that subsidence of entrained particulate matter will occur. Immediately beneath each incinerator is an ash transfer conveyer 94 which may include a drag chain for conveying ash and slag to an ash bin 96 on a continuous basis.

Air to support combustion in the primary combustion chamber 74 is provided by the blower 76 which is mounted on the exterior of the upper surface of each incinerator. Each of the blowers 76 may be of the constant speed centrifugal type driven by an electrical motor to produce a sufficient volume of air. Air is discharged into the interior of the primary combustion chamber 74 through an air discharge duct 98 which is connected to a manifold distribution system 100 which distributes the combustion air throughout the primary combustion chamber by means of a series of nozzles 102 along the interior of the wall incinerator and which are oriented to promote combustion and minimize particle entrainment and infiltration of atmospheric air. With such an air distribution system, it will be seen that the nozzle arrangement serves to selectively direct air into the primary combustion chamber 74 at selected locations so that jets of the air impinge in the flame or combustion area of the chamber rather than in the lower area of the chamber occupied by ash and slag residue. Impingement of the air into the combustion chamber serves to promote mixing of the air, RDF and combustion products. It also serves to minimize fluidization and agitation of the ash bed in the lower portion of the primary discharge chamber. Agitation of the ash that accumulates in the bottom of the chamber is undesirable in that entrainment and carryover of the ash with the combustion effluent gasses will result.

The arrangement of nozzles also serves to avoid directing jets of air at the space occupied by the incinerator feeder 70 as a load of RDF is discharged into the chamber 74 so that escape of ash, heat and flame are avoided when the incinerator feed door 71 is opened.

According to an important feature of the invention, the primary combustion chamber 74 is maintained at a reduced pressure level relative to the pressure of the surrounding atmosphere. This subatmospheric pressure arrangement produces a positive flow of air in the chamber 74 as the incinerator door 71 is opened to receive a load of RDF. This arrangement permits loading of additional RDF during combustion virtually without risk of injury to personnel or setting fire to nearby combustible RDF material, and avoids the outrush of flames associated with conventional, positive pressure incinerator arrangements. The subatmospheric pressure condition is established by the draft induced in the chambers by the high velocity discharge of the auxiliary fuel through the after burner chamber 86, the draft induced by the rise of the heated exhaust gases through a stack, as will be described hereinafter, and augmented by the draft induced by the operation of heat exchanger equipment, also described hereinafter.

The after burner chamber 86 is maintained at a predetermined temperature by the variable burner unit 88 which is mounted on the underside of the incinerator. The burner 88 discharges a mixture of natural gas and air into the chamber 36 through a gas discharge nozzle 104 which is centrally located in the bottom of the chamber 86. Gas is supplied to the nozzle 104 by a gas supply line 106 which includes variable valve means to throttle the supply of gas to the nozzle 104. The burner 88 supplies a continuous volume of air through the nozzle 104 while the valve means regulates the supply of fuel to the after burner at a variable rate to maintain a predetermined constant temperature in the after burner chamber.

The exhaust gases from the after burner chamber 86 are directed vertically through the after burner stack 90 which is a steel cylinder chamber having a lining of a suitable refractory material. The stack 90 is equipped with a cylindrical flue which is sized to maintain the required residence time within the after burner chamber to promote complete thermal oxidation of combustibles entrained in the off-gases from the primary combustion chamber. A spark arrester mesh screen (not shown) may be located over the upper end of the stack to confine any sparks or glowing embers within the incinerator. A rain shield 108 covers the upper ends of the stack.

The temperature of the exhaust gases in the after burner chamber 86 is measured by a thermocouple sensor 110 inserted into the stack 90 near the upper end. The thermocouple sensor is connected to a suitable temperature controller (not shown) for controlling the operation of the valve means in the gas fired burner.

According to an important feature of the invention, the combustion gases discharged through the exhaust stack 90 are exhausted to an associated device such as a steam boiler or generator using the heat energy in the combustion gases for producing steam. As can best be seen in FIG. 2, the exhaust gases are conveyed through an exhaust gas duct 112 to a steam generator 114. The steam generator 114 is a conventional water tube type waste heat boiler which is designed for high temperature flue gas heat recovery. The steam generator is equipped with a steam drum 116, a mud drum 118, refractory lining, access doors and the necessary valves, level controls and regulators. The steam drum is supplied with condensate which has been preheated by an economizer 120. The condensate is pumped through a condensate return line 122 by means of a boiler feed water pump 124. Saturated steam produced in the steam drum 116 is discharged through a steam line 126 for use in an industrial process, or for use in driving a prime mover such as a steam turbine driven alternator. The exhaust gases are withdrawn through the steam generator and economizer by means of a steam generator blower 128 which induces draft flow through the chambers 74, 86 to the exhaust stack 90 and duct 112 through the steam generator 114 and economizer 120. After heat has been exchanged in the economizer , the exhaust gases are discharged into the atmosphere through a discharge flue 130.

In a regenerative operating mode, a fraction of the exhaust gases are drawn through a regenerator duct 132 and are mixed with air from the interior of the building enclosure 10 in a transfer box 134 which is connected in fluid communication with the combustion air blower 76. The heated gases are circulated through the primary combustion chamber 74 thereby reducing the amount of auxiliary fuel required to support combustion.

According to an important feature of the invention, malodorous gases and air are evacuated from the interior of the building enclosure 10 through an air intake port 136 which is disposed in fluid communication with the interior of the building enclosure 10 and which passes through an interior wall 138. The air intake port 136 is connected to a transfer duct 140 which is connected in fluid communication with the transfer box 134. In operation, malodorous gases emanating from the municipal solid waste 16 and the refuse derived fuel 20 is withdrawn through the air intake port 136 and conducted through the transfer duct 140 into the transfer box 134 where it is mixed with the heated gases which are discharged through the exhaust stack 90 and regenerator duct 132.

Adequate combustion air can be withdrawn from the interior of the building enclosure 10 to provide the excess air condition required for proper operation of the incinerator. According to the preferred operation of the incinerator 72, combustion air is discharged into the primary combustion chamber 74 at some pressure higher than atmospheric pressure. The blower 76 is sized to maintain an excess air condition in the primary combustion chamber which is more than is necessary for a 100 percent theoretical combustion. The concept of "excess air condition" is explained in detail in U.S. Pat. No, 3,792,671 cited above.

Generally, it is desired that the pressure within the primary combustion chamber 74 be maintained at an excess air condition in the range of from 100 to 300 percent theoretical air. The effluent or off-gas from the primary chamber is conducted through the downpass chamber to the after burner chamber 86 where the gas burner 88 is throttled to compensate for fluctuations that may occur in the primary chamber. The auxiliary fuel supply 106 and burner 88 operate to maintain an essentially constant combustion temperature in the after burner chamber 86 and, therefore, if the incoming effluent from the primary chamber is incompletely combusted and contains a large volume of excess air, the after burner 88 will serve to provide supplementary combustion and oxidize any incompletely burned materials in the effluent from the primary chamber. Conversely, if the volume of excess air is slight, the temperature will remain high, and the heat supplied by the after burner can be reduced. The valve control mechanism in the burner 88 is typically set in the range of from 1400° F. to 2200° F. with the typical average setting being 1550° F. in the after burner chamber.

According to an important feature of the invention, the rate at which auxiliary fuel is injected into the chambers 74, 86 is controlled to ensure complete combustion of the off-gases to meet environmental standards, and in the temporary absence of a sufficient supply of RDF, to sustain the generation of a predetermined minimum level of heat energy in the exhaust gases for supporting the continuous production of steam.

In practical applications, the waste disposal and resource recovery system is housed within the building enclosure 10 to prevent the emission of malodorous gases into the atmosphere. Therefore, it is essential for proper operation of the system that the combustion air blower 76 when operating in combination with the steam blower 128 have sufficient capacity to maintain a net positive flow of ambient air surrounding the enclosure into the interior of the enclosure 10 whereby malodorous gases emanating from the municipal solid waste 16 and refuse derived fuel 20 are drawn into the primary combustion chamber for undergoing combustion during incineration of the RDF. According to this arrangement, air and malodorous gases are withdrawn from the interior of the building enclosure 10 at a rate sufficient to maintain a low air pressure condition inside of the enclosure relative to the atmospheric pressure of ambient air surrounding the enclosure whereby the malodorous gases and fugitive dust are withdrawn from the enclosure through the transfer duct 140 for undergoing combustion in the primary combustion chamber 74.

Referring to FIG. 1, it will be seen that an entrance door 142 and an exit door 144 are provided in the building enclosure 10 to permit the entry and exit of collection trucks 12 for dumping the municipal solid waste on the tipping floor 14. These doorways may be provided with doors (not shown) which when closed effectively seal the building enclosure to prevent the escape of malodorous gases. However, on collection days when municipal solid waste is collected and deposited in the enclosure, the doors will be opened most of the time. To further prevent the escape of malodorous gases, a curtain of air 146 is directed across each doorway by means of an air curtain blower assembly 146. The air curtain produces a high pressure zone across the doorway which substantially minimizes the escape of malodorous gases through the opening. This feature, in combination with the induced draft of the blower 76 and steam generator blower 128, virtually eliminate the escape of malodorous gases from the building enclosure. Therefore, a considerable amount of municipal solid waste and processed refuse derived fuel can be stored within the enclosure to permit continuous operation of the system while complying with pollution regulations and without emitting offensive odors.

In summary, the present invention provides apparatus and process for recovery of resources and thermal energy incidental to the solid waste reduction process. The thermal oxidation of refuse derived fuel extracted from the solid waste material is substantially complete so that no harmful emissions are introduced into the atmosphere by the combustion process. Additionally, primary and intermediate storage areas are provided for accumulating a relatively large volume of solid waste material and refuse derived fuel for ensuring continuous operation of the incineration process and the heat recovery process. The incinerator is operated in a "negative pressure" condition to permit continuous, safe loading of refuse derived fuel as combustion occurs. The injection of auxiliary fuel into the after burner chamber of the incinerator is controlled to provide for complete thermal reduction of the off-gases produced in the primary chamber, and in the absence of a sufficient supply of refuse, to sustain the generation of a predetermined level of heat energy in the exhaust gases for supporting the continuous production of steam. Finally, the forced draft of interior air into the primary combustion chamber of the incinerator ensures that the malodorous gases emanating from accumulated municipal solid waste and refuse derived fuel will undergo combustion during the incineration process.

Although a preferred embodiment of the invention has been described in detail, it should be understood that the various changes, substitutions, and alterations can be made therein without departing from the spirit and scope of the invention as defined by the appended claims.

What is claimed is:

1. A waste disposal system comprising, in combination:

an incinerator for thermally oxidizing combustible waste material having a primary combustion chamber, a secondary combustion chamber, and passageway means connecting the primary chamber in fluid communication with the secondary chamber, and an exhaust stack connected in fluid communication with the seconardy combustion chamber;

means for injecting a quantity of combustion air into the primary chamber at a pressure greater than atmospheric pressure, the quantity of combustion air being in excess of the amount necessary to support complete thermal oxidation of the waste material; and, means for evacuating gaseous products of combustion from the primary combustion chamber through the passageway means to the secondary combustion chamber and through the exhaust stack at a rate sufficient to maintain the air pressure inside of the primary combustion chamber at a level which is substantially lower than the atmospheric pressure surrounding the incinerator.

2. The waste disposal system as defined in claim 1, the combination further including:

means for directing a high velocity jet of auxiliary fuel through the secondary combustion chamber and exhaust stack.

3. The waste disposal system as defined in claim 2 the combination further comprising:

regulator means for controlling the rate that auxiliary fuel is injected into the secondary combustion chamber for providing substantially complete combustion of the waste material and for sustaining the generation of a predetermined level of heat energy in the exhaust products of combustion during the temporary absence of a sufficient supply of combustible waste material.

4. A waste disposal system comprising, in combination:

an incinerator for thermally oxidizing combustible waste material having a primary combustion chamber, a secondary combustion chamber, and passageway means connecting the primary chamber in fluid communication with the secondary combustion chamber;

means for injecting a quantity of combustion air into the primary chamber at a pressure greater than atmospheric pressure, the quantity of combustion air being in excess of the amount necessary to support complete thermal oxidation of the waste material; and, means for evacuating products of combustion and excess combustion air from the primary combustion chamber through the passageway means into the secondary combustion chamber at a rate sufficient to maintain the air pressure inside of the primary combustion chamber at a level which is lower than the atmospheric pressure surrounding the incinerator.

5. A waste disposal system comprising, in combination:

an incinerator for thermally oxidizing combustible waste material having a primary combustion chamber for receiving the combustible refuse, a secondary combustion chamber, and passageway means interconnecting the primary combustion chamber in fluid communication with the secondary combustion chamber;

means for injecting a quantity of combustion air into the primary chamber at a pressure greater than atmospheric pressure, the quantity of combustion air being in excess of the amount necessary to support complete thermal oxidation of the waste material;

means for evacuating combustion products and excess combustion air from the primary combustion chamber through the passageway means into the secondary combustion chamber at a rate sufficient to maintain the pressure inside of the primary combustion chamber during combustion at a level which is less than the atmospheric pressure surrounding the incinerator; and, means for injecting auxiliary fuel into the secondary chamber for reacting with the excess combustion air to provide for substantially complete thermal oxidation of the combustion products conducted through the passageways means.

6. The waste disposal system as defined in claim 5, the combination including:

an exhaust stack connected in fluid communication with the secondary combustion chamber, the exhaust stack being vertically disposed relative to the secondary combustion chamber; and the injecting means including a discharge nozzle for directing a high velocity jet of auxiliary fuel vertically through the exhaust stack.

7. The waste disposal system as defined in claim 5, the combination further comprising:

regulator means coupled to the auxiliary fuel injection means for controlling the rate that auxiliary fuel is injected into the secondary combustion chamber for providing substantially complete combustion of the combustion products and for sustaining the generation of a predetermined level of heat energy in the exhaust produucts of combustion.

8. A waste disposal system comprising, in combination a building enclosure having an interior storage area for accumulating a volume of combustible refuse derived from solid waste material;

an incinerator for thermally oxidizing the combustible refuse having a primary combustion chamber connected in fluid communication with the interior of the building enclosure, a secondary combustion chamber, and passageway means interconnecting the primary combustion chamber in fluid communication with the secondary combustion chamber;

means for evacuating air from the interior of the building enclosure into the primary combustion chamber at a rate sufficient to maintain the primary combustion chamber in an excess air condition as combustion occurs and sufficient to maintain a relatively low air pressure condition inside of the building enclosure relative to the atmospheric pressure surrounding the building enclosure whereby malodorous gases emanating from the waste material accumulated within the building enclosure are drawn into the primary combustion chamber for undergoing combustion with the combustible refuse; and, means for evacuating gaseous products of combustion from the primary combustion chamber through the passageway means to the secondary combustion chamber at a rate sufficient to maintain the air pressure inside of the primary combustion chamber at a level which is lower than the ambient pressure within the building enclosure.

9. The combination as defined in claim 8, the building enclosure having an opening for permitting entry of a vehicle therein for off loading solid waste material into the interior storage area, the combination further including blower means mounted on the enclosure for maintaining a curtain of moving air across the opening.

10. A waste disposal system comprising, in combination;

an enclosure having an interior storage area for accumulating combustible refuse;

an incinerator having a primary combustion chamber connected in fluid communication with the interior of the enclosure, an afterburner combustion chamber connected in fluid communication with the primary chamber, and an exhaust stack connected in fluid communication with the afterburner chamber;

means for evacuating air from the interior of the enclosure into the combustion chamber at a rate sufficient to maintain an excess air condition within the primary combustion chamber and at a rate sufficient to maintain low air pressure condition inside of the enclosure relative to the atmospheric pressue of ambient air surrounding the enclosure thereby producing a net positive flow of ambient air from outside of the enclosure into the interior of the enclosure;

means for evacuating combustion products and excess combustion air from the primary combustion chamber into the afterburner chamber at a rate sufficient to maintain the air pressure inside of the primary combustion chamber at a level which is lower than the ambient pressure within the enclosure whereby particulate material and malodorous gases emanating from the combustible refuse accumulated in the enclosure are drawn into the combustion chamber for undergoing combustion; and, means for injecting auxiliary fuel into the afterburner chamber at a variable rate for reacting with the combustion products and excess air to maintain a predetermined operating temperature in the exhaust stack.

11. A waste disposal and energy recovery system for receiving solid waste material according to an irregular schedule and for thermally reducing combustibles derived from the solid waste material and producing heat energy for driving a heat exchanger at a rated load level according to a continuous schedule, said system comprising:

an incinerator for thermally oxidizing combustible waste material having a primary combustion chamber, a secondary combustion chamber, and passageway means connecting the primary chamber in fluid communication with the secondary combustion chamber;

means for injecting a quantity of combustion air into the primary chamber at a pressure greater than atmospheric pressure, the quantity of combustion air being in excess of the amount necessary to support complete thermal oxidation of the waste material;

a heat exchanger having a high temperature heat exchange passage connected in fluid communication with the secondary combustion chamber for receiving exhaust combustion products;

means for evacuating products of combustion and excess combustion air from the primary combustion chamber through the passageway means into the secondary combustion chamber and through the heat exchanger at a rate sufficient to maintain the air pressure inside of the primary combustion chamber at a level which is lower than the atmospheric pressure surrounding the incinerator; and, means for injecting auxiliary fuel into the combustion chamber of the incinerator for reacting with the excess combustion air to provide for substantially complete combustion of the combustibles entrained in the off gases produced in the primary combustion chamber, and in the absence of a sufficient supply of combustible refuse, for sustaining the generation of a predetermined minimum level of heat energy in the exhaust products of combustion for continuously driving the heat exchanger at a rated load.

12. The waste disposal and energy recovery system as defined in claim 11, the evacuating means comprising an induction blower connected in fluid communication with the heat exchanger for inducing a draft flow of gaseous products of combustion from the secondary combustion chamber through the heat exchanger.

13. The waste disposal system and energy recovery system as defined in claim 11, including an exhaust stack connected in fluid communication with the secondary combustion chamber, the combustion air injection means comprising a transfer chamber connected to receive ambient combustion air, and an exhaust return duct connected intermediate the exhaust stack and transfer chamber to circulate a fraction of the heated gases discharged through the exhaust stack into the transfer chamber for mixing with the ambient combustion air.

* * * * *

UNITED STATES PATENT AND TRADEMARK OFFICE

CERTIFICATE OF CORRECTION

PATENT NO. : 4,193,354

DATED : March 18, 1980

INVENTOR(S) : Maurice G. Woods

It is certified that error appears in the above—identified patent and that said Letters Patent is hereby corrected as shown below:

Abstract - line 10, "subatomspheric" should be -- subatmospheric --.

Column 5, line 5, "generators" should be -- generator --.

Column 6, line 16, "49 inches in diameter" should be -- 48 inches in diameter --.

Column 6, line 23, "recovered by by the" should be -- recovered by the --.

Column 6, line 60, "combinaton" should be -- combination --.

Column 8, line 24, "feed" should be -- feeder --.

Column 8, line 56, "burner at" should be -- burner chamber at --.

Column 11, line 41, "that the various" should be -- that various --.

Column 11, line 54, "seconardy" should be -- secondary --.

UNITED STATES PATENT AND TRADEMARK OFFICE

CERTIFICATE OF CORRECTION

PATENT NO. : 4,193,354

DATED : March 18, 1980

INVENTOR(S) : Maurice G. Woods

It is certified that error appears in the above—identified patent and that said Letters Patent is hereby corrected as shown below:

Column 12, line 66, "passageways" should be -- passageway --.

Column 14, line 4, "pressue" should be -- pressure --.

Signed and Sealed this

*Thirtieth* Day of *December 1980*

[SEAL]

*Attest:*

SIDNEY A. DIAMOND

*Attesting Officer*

*Commissioner of Patents and Trademarks*